United States Patent [19]

Yaffe

[11] Patent Number: 4,953,713

[45] Date of Patent: Sep. 4, 1990

[54] BALLOON POSITIONING DEVICE

[76] Inventor: Barry M. Yaffe, 15200 Hannans Way, Rockville, Md. 20853

[21] Appl. No.: 430,066

[22] Filed: Nov. 1, 1989

Related U.S. Application Data

[63] Continuation of Ser. No. 130,518, Dec. 8, 1987, abandoned.

[51] Int. Cl.[5] ..... A47F 7/00

[52] U.S. Cl. ..... 211/13; 206/460; 248/121; 446/221; 446/223

[58] Field of Search ..... 248/121, 544, 558, 205.3; 446/220, 221, 223, 225, 226; 206/460, 526; 211/13, 14

[56] References Cited

U.S. PATENT DOCUMENTS

| | | | |
|---|---|---|---|
| 871,198 | 11/1907 | Aiken | 248/121 X |
| 1,464,241 | 8/1923 | Daiger | 211/13 |
| 2,409,867 | 10/1946 | Jones | 211/13 |
| 2,775,048 | 12/1956 | Berman | 446/901 X |
| 2,882,645 | 4/1959 | Stivers | 446/220 |
| 2,922,252 | 1/1960 | Van Dam et al. . | |
| 3,450,405 | 6/1969 | Mates | 446/901 X |
| 4,589,854 | 5/1986 | Smith . | |
| 4,850,926 | 7/1981 | Lovik | 446/220 X |
| 4,879,823 | 11/1989 | Collins | 446/222 X |
| 4,892,500 | 1/1990 | Lau | 446/221 |

FOREIGN PATENT DOCUMENTS

| | | | |
|---|---|---|---|
| 270200 | 5/1927 | United Kingdom | 446/220 |

*Primary Examiner*—David L. Talbott

*Attorney, Agent, or Firm*—Fleit, Jacobson, Cohn, Price, Holman & Stern

[57] ABSTRACT

A balloon positioning device that is used in forming balloon clusters including a supporting base structure and an upstanding support member having a plurality of vertically spaced attachment points thereon to which a plurality of balloon ribbons, strings or the like are connected so that balloons can be arranged in various patterns with desired numbers of balloons located at selected vertical orientations to form desired arrangements of a plurality of balloons so that once the balloons have been arranged, the ribbons, strings or the like can be separated from the attachment points and tied or otherwise connected together in order to maintain the balloons in a desired cluster.

5 Claims, 1 Drawing Sheet

FIG. 1
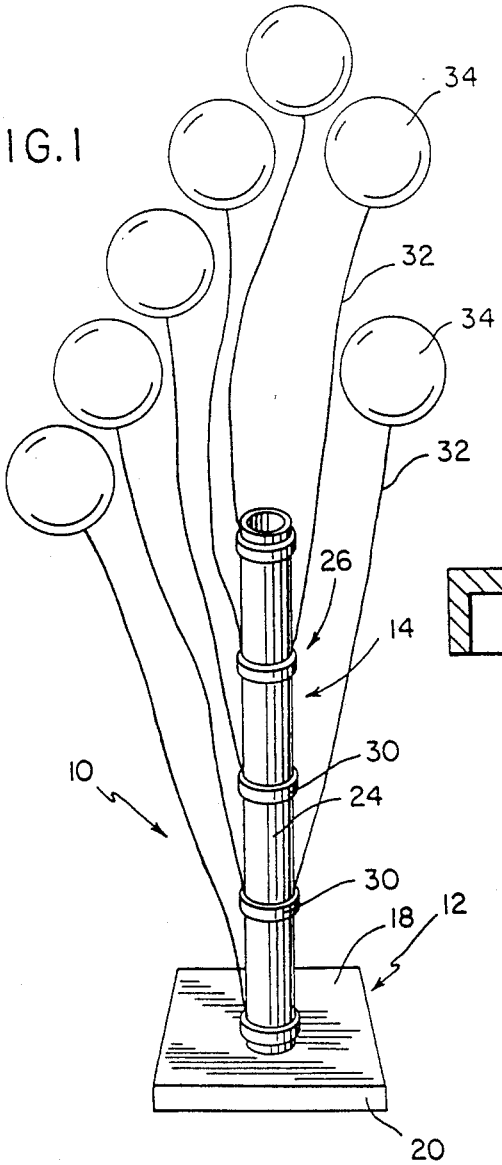
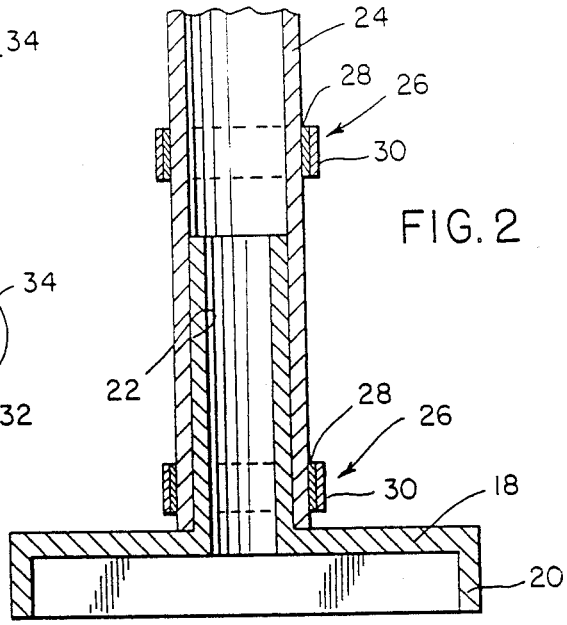
FIG. 2
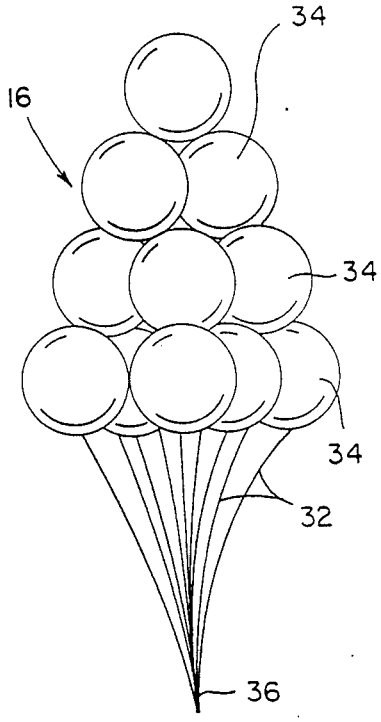
FIG. 4
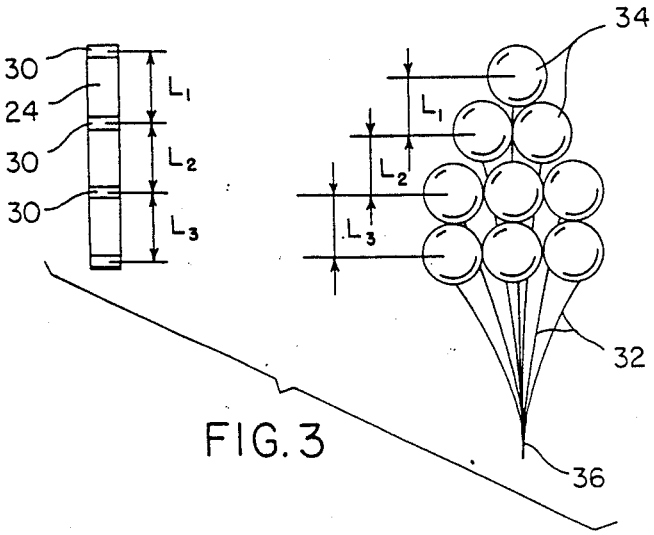
FIG. 3

BALLOON POSITIONING DEVICE

This application is a continuation of application Ser. No. 130,518 filed Dec. 8, 1987 now abandoned.

BACKGROUND OF THE INVENTION

1. Field of the Invention

The present invention relates to a balloon positioning device that is used in forming balloon clusters. The balloon positioning device includes a supporting base structure and an upstanding support member having a plurality of vertically spaced attachment points thereon to which a plurality of balloon ribbons, strings or the like are connected so balloons can be positioned in various patterns with desired numbers of balloons located at selected vertical orientations to form desired arrangements of a plurality of balloons so that once the balloons have been arranged, the ribbons, strings or the like can be separated from the attachment points and tied or otherwise connected together in order to maintain the balloons in a desired cluster.

2. Information Disclosure Statement

In many areas, balloon decorations are used in clusters for various purposes such as celebrating birthdays, anniversaries, promotions and other similar personal and business party-type events. Balloons usually are constructed of latex rubber or Mylar and are inflated with air or a lighter than air gas, usually helium. When helium is used, the balloons will float upwardly and when air is used, the balloons will hang downwardly. The balloon arrangement, which may consist of from 4 to 50 balloons, is usually formed by a person grasping the ribbons or strings which are tethered to the balloons. In a cluster, each balloon is attached to its ribbon which may be decorative material of diverse colors and materials or ordinary string, monofilament line, twine and the like. In the balloon industry a cluster is usually provided in a particular selection of colors, sizes and materials and the cluster may then be delivered to a customer in various manners including the rendition of songs, greetings and the like. For large events, multiple clusters are placed throughout a banquet area, being used as table centerpieces, space dividers and as stationary decorations. It is not uncommon for dozens of clusters to be used in a single event, employing hundreds or thousands of balloons. The arrangement of balloons in clusters is quite labor intensive in that it requires considerable time of an individual to arrange each cluster. Prior art devices are known to support balloons such as an elongated dowel, stick or the like and devices are known to attach to balloons to support them in various places, including on horizontal surfaces and the like, and devices are attached to balloons to facilitate their inflation. However, the prior art does not include any devices to assist in arranging balloons in clusters. A separate information disclosure statement will be filed.

SUMMARY OF THE INVENTION

An object of the present invention is to provide a balloon positioning device which will materially reduce the time required to arrange a cluster of balloons which includes a supporting base structure and an upright support member having a plurality of attachment points thereon to which the balloon ribbons or strings may be temporarily attached to arrange the balloons in the desired arrangement or cluster so that all of the ribbons or strings can then be detached from their attachment points and secured together to maintain the balloons in their desired clustered arrangement.

Another object of the invention is to provide a balloon positioning device in accordance with the preceding object in which the base and upright support member are detachably connected to enable various types of support members to be attached to the base with the support members having different arrangements of attachment points which facilitate the arrangement of balloons in clusters having various configurations.

A further object of the invention is to provide a balloon positioning device in which the upright support member is in the form of a rectangular or circular tubular member and the attachment points may be in the form of adhesive members which encircle the support at different elevations so that the balloons which have ribbons of the same length attached thereto can be attached to the adhesive strips at the different elevations to arrange the balloons in desired clustered arrangements in which the balloons are also at different elevations commensurate with the variations of elevation of the adhesive strips. More than one configuration of elevation spacings can be placed on the tube, for example, at different regions of the circumference of a circular tube or on different faces of rectangular tubes.

Still another object of the invention is to provide a balloon positioning device in accordance with the preceding objects which is simple in construction, easy to use, effective in efficiently arranging balloons uniformly while reducing the time required to arrange a cluster of balloons.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the balloon positioning device of the present invention illustrating the manner in which balloons are connected thereto in forming a cluster.

FIG. 2 is a fragmental sectional view, on an enlarged scale, illustrating the construction of the base and supporting member forming a portion of the balloon arranger.

FIG. 3 is a schematic view illustrating the relationship between the vertical spacing of the attachment points on the support member and the vertical spacing of the balloons in a cluster.

FIG. 4 is a perspective view illustrating a balloon cluster formed by the balloon positioning device of the present invention.

DESCRIPTION OF THE PREFERRED EMBODIMENT

Referring now specifically to the drawings, the balloon positioning device of the present invention is generally designated by the numeral 10 and includes a base generally designated by the numeral 12 and an upright support member generally designated by the numeral 14 and the balloon positioning device is used to form a cluster of balloons as illustrated in FIG. 4 and designated by numeral 16.

The base 12 includes a generally horizontally disposed base member 18 in the form of a metal, plastic or wood plate which may be provided with a downturned peripheral edge 20 if desired in order to be movably supported on a support surface such as a horizontally disposed workbench or the like. If desired, the base 12 may be permanently anchored in any desired location. Centrally on the base member 18 is an upstanding tubular member 22 that is rigid with or integral with the base member 18 with the tubular member 22 being telescopically received in the upright support member 14 which is also an elongated tubular member 24 with the interior dimension and shape of the tubular member 24 being substantially equal to but slightly greater than the external dimension and shape of the upstanding member 22 on the base member 18 so that the tubular support member 24 can be inserted onto or removed from the base whenever desired. This permits tubular support members of different lengths and different characteristics to be placed on the base 12. While tubular member 12 is illustrated as being circular in transverse cross-sectional configuration, other cross-sectional configurations may be used such as rectangular, square, triangular or other polygonal configurations.

The tubular support member 24 includes a plurality of attachment points positioned in vertically spaced relation thereon with each attachment point being designated by the numeral 26 and being in the form of a strip of tape 28 which encircles and is attached to the exterior surface of the tubular support member 24. Adhesive strips 30 which may be double-faced adhesive so that one face of the adhesive secures the strip to the tape 28 on tubular member 24 and the outer surface of the adhesive strip 30 forms an attachment point for a balloon ribbon or string 32 that is connected to a balloon 34 with a plurality of the balloons 34 being used to form the balloon cluster 16 as illustrated in FIG. 4. Other types of attachment points such as clasps, snaps, springs, magnets or the like may be used in lieu of the adhesive type attachment points.

FIG. 3 illustrates the relationship between the vertically spaced attachment strips 30 and the orientation of the balloons 34 in a typical cluster. The vertical distances between the strips 30 are designated by $L_1$, $L_2$, $L_3$ while the same vertical spacing of the balloons is designated in the same manner. It will be apparent that the distances between the attachment strips 30 can be varied which will vary the arrangement of the balloons in a vertical spatial relationship since all of the ribbons or strings will be cut to the same length to start the arrangement of the cluster.

As indicated, the base may be constructed of a heavy, sturdy material such as aluminum and can serve as the base for many different tubular support members 24. As illustrated, a circular tubular support member may have a diameter ranging between two to four inches and may be constructed of stainless steel, aluminum, polyvinyl chloride pipe, plastic resin tubing or any other tubular member and also may be of solid construction and may be of configurations other than cylindrical. The attachment strips 30 are in the form of a double strip adhesive and indicating lines or other markers may be provided on the tubular support member in lieu of tape strips 28 to indicate the position of the attachment points. For example, if a 10 balloon cluster is to be provided, in which each balloon is 11" in diameter, and are to be arranged in nested tiers of one at the top and three rows of three balloons each as illustrated in FIG. 3, there would be a requirement for four of the fastener points or strips 30. The locator members on the tubular support member 24 may be in the form of aluminum tape 28 permanently bonded to the tubular member, plastic bands, strips, a plastic tube or painted on indicia to indicate the positioning of the double-faced adhesive strips 30 or other types of attachment points. The strip 30 of adhesive would have a length equal to the circumference of the tube and would be placed to adhere to the tube at the indicated markers. The ribbons 32 are then attached to the adhesive strips by pressing the end of the ribbon to the adhesive. As adhesive is used, it tends to lose its sticking power and when this occurs the adhesive tape can merely be removed from the locator members on the tubular member 24 and another strip of adhesive tape attached.

Prior to the development of this invention, a person engaged in arranging balloons, usually referred to as a balloon artist, arranged the clusters manually by cutting all of the ribbons that he needed beforehand in the appropriate colors and to a uniform length. Clusters are distinguished by the attributes of the number of balloons, the size of the balloons and the placement of tiers and the colors. After selecting the balloons and determining what type of cluster is to be utilized such as close packed, separated, tiers, vertical columns or the like and how many balloons are to be used, the artist then inflates the balloons, tying off the ends to seal them by tying a precut ribbon or securing the precut ribbon to the sealed end of the balloon. When enough balloons for the cluster have been completed, the assembling of the cluster begins. The balloons needed for the cluster are selected and held together by the artist and the ribbons are then moved up or down to attain proper vertical placement with the artist usually observing the placement in a mirror or requiring an assistant to judge. The balloons are adjusted or replaced with different colors as deemed necessary by the artist and when all of this has been completed, the ribbons are tied together. This is a tedious, laborious and time-consuming job. Constructing many clusters that are uniform in design requires even more painstaking and time consuming adjustment. Usually, when forming a cluster that may involve 10 to 20 balloons, a competent balloon artist can complete one cluster in approximately 20 minutes, although this may vary depending upon the arrangement of colors and other variations in the cluster.

By using the present invention, considerable time and frustration can be saved. When using the invention, the balloon artist cuts the ribbons ahead of time as in the conventional manner and then inflates the balloons, ties off the ends to seal in the gas and attaches a ribbon as in the conventional manner. Then, the free end of the ribbon is attached to an adhesive strip 30 which has been placed in a proper position to determine the tier that the balloon will reside in. Usually, the color of the balloon defines which tier it is to be placed in and hence the appropriate fastener strip 30 will be used to attach that particular balloon. The artist continues to place the ribbon ends of each newly inflated balloon onto the appropriate fastener strip 30 and after all of the balloons in the cluster have been placed, they can be changed or adjusted very simply by moving the ribbon ends among the fastener strips 30. When the desired arrangement is attained, the balloon artist will gather and grip the strings or ribbons together directly above the top of the tube 24 and cut them free of the tube and tie off the group of ribbons by joining them with a knot or plastic clip such as schematically illustrated at 36 in FIG. 3. Different upright support members 14 with different arrangements of fastener strips 30 may be provided with the fastener strips 30 permanently attached thereto but also being replaceable to renew the adhesive tape so that the upright support members 14 will provide a predetermined cluster arrangement thereby enabling interchange of the upright support members for producing different types of clusters.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination, a balloon positioning device for positioning balloons in tiers in a cluster in which the tiers are oriented at different vertical elevations, and a plurality of balloons having substantially equal length ribbons attached thereto, said device comprising a generally vertically disposed support member, a plurality of attachment points on said support member in predetermined vertically spaced relation corresponding to the difference in vertical elevation of the tiers of balloons whereby balloons attached to the attachment points are positioned at different elevations to form a balloon cluster in which the tiers of balloons are at different elevations.

2. The combination as defined in claim 1 wherein said support member is supported by a base structure adapted to be supported from a supporting surface and means detachably connecting the support member to said base structure to enable interchange of support members with respect to the base structure to enable support members with differently spaced attachment points to be utilized with the base structure to enable variation in the cluster arrangement of balloons.

3. The combination as defined in claim 2 wherein said means connecting the support member to the base structure includes an upstanding projection on the base structure, said support member being tubular and telescoped over the projection to enable interchange of tubular support members.

4. The combination as defined in claim 3 wherein said attachment points on the tubular support member each includes a peripheral strip of adhesive material to adhesively secure the balloon ribbons thereto temporarily while the balloons are being arranged in a cluster with the ribbons being grasped after the cluster of balloons has been formed and separated from the tubular support member attachment points and connected together to retain the cluster in the desired permanent arrangement.

5. The method of forming balloon clusters consisting of the steps of inflating a predetermined number of balloons of selected sizes and colors, attaching equal length tether lines to the balloons, providing a plurality of temporary attachment points for the balloon tether lines at predetermined elevations to orient the balloons at different elevations, grasping all of the tether lines and separating them from the temporary attachment points and securing the tether lines together to permanently retain the orientation of the balloons to form a cluster.

* * * * *